US005664746A

United States Patent [19]

Benzakarya

[11] Patent Number: 5,664,746

[45] Date of Patent: Sep. 9, 1997

[54] BABY BOTTLE HOLDER

[76] Inventor: David S. Benzakarya, 3300 1-2 Penn Mar Ave., Elmonte, Calif. 91732

[21] Appl. No.: 243,811

[22] Filed: May 17, 1994

[51] Int. Cl.[6] ..... A47D 15/00

[52] U.S. Cl. ..... 248/106; 248/288.31

[58] Field of Search ..... 248/102, 103, 248/105, 106, 107, 288.3; 215/11.1, 100 R

[56] References Cited

U.S. PATENT DOCUMENTS

| | | | |
|---|---|---|---|
| 892,800 | 7/1908 | Black | 248/103 |
| 1,084,427 | 1/1914 | Hanks | 248/103 |
| 1,900,691 | 3/1933 | Carlson | 248/102 |
| 1,970,602 | 8/1934 | Geistlinger | 248/103 |
| 2,470,694 | 5/1949 | Foo | 248/106 |
| 2,557,570 | 6/1951 | Seiger | 248/106 X |
| 3,627,244 | 12/1971 | Nicholas | 248/103 |
| 4,735,388 | 4/1988 | Marks | 248/103 |

*Primary Examiner*—Ramon O. Ramirez
*Attorney, Agent, or Firm*—Christie, Parker & Hale, LLP

[57] ABSTRACT

There is provided an adjustable baby bottle holder consisting of a weighted base providing an opening in which there is inserted a ball. The ball rotates within the opening by action of a bias spring under the ball. The first arm extends outward from the ball and slidably engages a clamp coupled to a second arm to which there is attached an insulated container to receive a baby bottle. By adjusting the positions of the arm and the insulated container, the combination in cooperation adjusts the bottle for feeding of a baby.

1 Claim, 1 Drawing Sheet

BABY BOTTLE HOLDER

My invention is a baby bottle holder to help mothers and others to feed babies when busy at home, at work or anyplace.

SUMMARY OF THE INVENTION

The primary object of this invention is to feed babies by holding the baby bottle by its bottom and by inserting the baby bottle in the sleeve insulated to keep the baby's formula warm. These arms are intended to support and regulate the position of a baby bottle to make it easy to reach a baby's mouth to feed the baby. The base is constructed of heavy plastic to keep it from moving; also the base has a center hole to hold a ball which can be rotated to adjust the long arm in any position. To hold the ball and permit its rotation, a spring is provided which pushes the ball against the center hole in the base. To keep the spring tension against the ball, a washer is provided which has three notches equally distributed on the washer's perimeter. The purpose of the notches is to retain a washer in place when the washer is pressed against the base. The base has three undercuts in its neck; these undercuts match with the notches to keep the washer from being removed by spring pressure. An important feature is that the component parts can be easily assembled without the use of any tool and easily mass-produced. The object of the invention will become more apparent as the following detailed description of an illustrative embodiment of the invention proceeds, with reference to the attached drawing.

DESCRIPTION OF THE ILLUSTRATIVE EMBODIMENT

Figure 1:
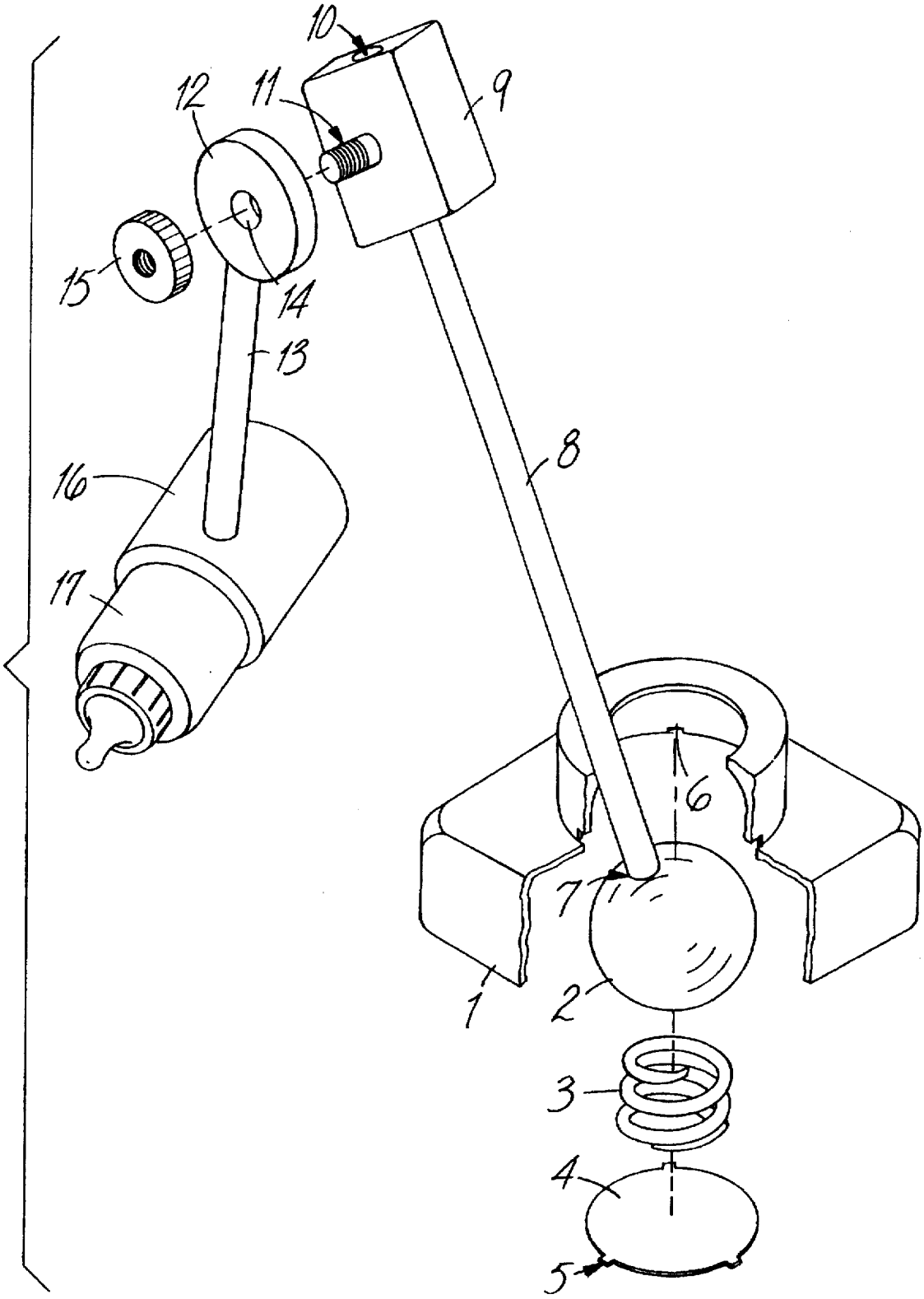
FIG. 1 is a top cutaway perspective view of the bottle holder base showing the element parts invented.

Referring more particularly to the drawing by character of reference, FIG. 1 shows a rectangular heavy base 1 for standing in any flat surface which has on the top thereof a center hole in which there is seated ball 2. Ball 2 is urged against the base's top center hole by the pressure of spring 3, and the spring 3 is retained in place by means of washer 4. Washer 4 has three notches 5 equally distributed on its perimeter. The washer's three notches 5 are designed to fit in three undercuts 6 equally distributed on the bottom of the inside perimeter of the base's center hole, which communicates with the base's top center hole. The ball 2 has a small perforation 7 to hold the long arm 8 which is press fit in the small perforation 7 to hold the long arm 8. Long arm 8 is mounted onto a rectangular clamp 9 which has a through hole 10 to adjust by sliding the rectangular clamp 9 up and down along long arm 8. Rectangular clamp 9 has also a screw 11 molded in one of its surfaces for the purpose of holding the flat washer 12. Flat washer 12 is molded to the short arm 13. Flat washer 12 has a center hole 14 for retention by means of nut 15. On the other end of the short arm 13 is molded a sleeve 16. The inside of sleeve 16 is insulated to keep baby's bottle 17 warm.

As would be evident from the above, in use, baby's bottle the rectangular heavy base is allowed to stand on a flat surface. Long and short arms and attached insulated sleeve are positioned and the clamps provided and the tension of the spring on the ball used to position the bottle at the approximate zone of the baby's mouth. The clamps are tightened and the baby's bottle inserted in the sleeve for feeding of the baby.

What is claimed is:

1. A baby bottle holder comprising:

a) a weighted base providing an opening forming a socket to receive a ball;

b) a ball adapted to be urged against the opening in the base;

c) spring mean biased against the ball;

d) washer mean providing extending outwardly tabs;

e) openings in the base receiving said tabs;

f) a first arm extending outward from the ball slidably engaging clamp means;

g) a second arm rotatably secured to said clamp means; and h) an insulated container for a baby bottle, said container adapted to rotate about an axis normal to said first arm, and said arms cooperating to permit adjustment of the location of the baby bottle for feeding of a baby.

* * * * *